US011536054B2

(12) United States Patent
Chen

(10) Patent No.: US 11,536,054 B2
(45) Date of Patent: Dec. 27, 2022

(54) ELECTRIC STRIKE LOCK

(71) Applicant: POWERTEK HARDWARE CO., LTD., Taichung (TW)

(72) Inventor: Chung-Yu Chen, Taichung (TW)

(73) Assignee: POWERTEK HARDWARE CO., LTD., Taichung (TW)

( * ) Notice: Subject to any disclaimer, the term of this patent is extended or adjusted under 35 U.S.C. 154(b) by 309 days.

(21) Appl. No.: 16/831,831

(22) Filed: Mar. 27, 2020

(65) Prior Publication Data

US 2021/0277686 A1 Sep. 9, 2021

(30) Foreign Application Priority Data

Mar. 5, 2020 (TW) ..... 109107320

(51) Int. Cl.
*E05B 63/24* (2006.01)
*E05B 47/00* (2006.01)
*E05B 59/00* (2006.01)

(52) U.S. Cl.
CPC ..... *E05B 63/244* (2013.01); *E05B 47/0012* (2013.01); *E05B 47/0046* (2013.01);
(Continued)

(58) Field of Classification Search
CPC ..... Y10T 292/696; Y10T 292/0843; Y10T 292/68; Y10T 292/699; E05B 63/244; E05B 47/0012; E05B 59/00; E05B 2047/0017; E05B 2047/0002; E05B 2047/0036; E05B 63/24; E05B 47/0046; E05B 47/00; E05B 47/0001; E05B 2047/002; E05Y 2201/722
See application file for complete search history.

(56) References Cited

U.S. PATENT DOCUMENTS 297,096 A * 4/1884 Woehrle ..... E05B 47/0047 292/341.16
325,299 A * 9/1885 Whitney ..... E05B 63/244 292/341.15

(Continued)

FOREIGN PATENT DOCUMENTS

DE 4033840 C2 * 12/1994 ..... E05B 47/0046
GB 2205893 A * 12/1988 ..... E05B 47/0012

(Continued)

*Primary Examiner* — Kristina R Fulton
*Assistant Examiner* — Steven A Tullia
(74) *Attorney, Agent, or Firm* — Pai Patent & Trademark Law Firm; Chao-Chang David Pai

(57) ABSTRACT

An electric strike lock is disclosed. The electric strike lock cooperates with a lock when in use. The lock has a lock tongue. The electric strike lock includes a base. The base has an opening for accommodating the lock tongue. The base has a pair of grooves corresponding to two opposite sides of the opening. Two sliding members are slidably disposed in the respective grooves. The sliding members are connected with at least one driving unit for the sliding members to slide closer to each other so that the lock tongue is engaged in the opening, or for the sliding members to gradually slide away from each other so that the lock tongue is disengaged from the opening, thereby performing locking and unlocking operations on a door in a sliding manner.

7 Claims, 7 Drawing Sheets

(52) U.S. Cl.
CPC ..... *E05B 59/00* (2013.01); *E05B 2047/002* (2013.01); *E05B 2047/0017* (2013.01); *E05B 2047/0036* (2013.01); *E05Y 2201/722* (2013.01)

(56) References Cited

U.S. PATENT DOCUMENTS

| | | | | | |
|---|---|---|---|---|---|
| 4,984,835 | A * | 1/1991 | Vadacchino | E05B 47/0047 | 292/144 |
| 6,390,520 | B1 * | 5/2002 | Holzer | E05B 47/0046 | 292/341.16 |
| 7,021,684 | B2 * | 4/2006 | Orbeta | E05B 47/0046 | 292/201 |
| 8,047,585 | B1 * | 11/2011 | Peabody | E05B 47/0046 | 292/341.15 |
| 8,096,594 | B2 * | 1/2012 | Uyeda | E05B 47/0046 | 292/341.15 |
| 8,454,063 | B2 * | 6/2013 | David | E05B 47/0046 | 292/341.15 |
| 9,702,167 | B2 * | 7/2017 | Liao | E05B 47/0046 | |
| 2018/0044945 | A1 * | 2/2018 | Geringer | E05B 65/1093 | |

FOREIGN PATENT DOCUMENTS

| | | | | |
|---|---|---|---|---|
| GB | 2334067 A | * | 8/1999 | E05F 15/76 |
| SE | WO-8403909 | * | 10/1984 | E05B 47/0046 |
| WO | WO-0208552 A1 | * | 1/2002 | E05B 63/244 |

* cited by examiner

ELECTRIC STRIKE LOCK

FIELD OF THE INVENTION

The present invention relates to an electric strike lock, and more particularly to an electric strike lock that performs locking and unlocking operations on a door in a sliding manner.

BACKGROUND OF THE INVENTION

A conventional electric strike lock cooperates with a lock when in use. The lock has a lock tongue. The conventional electric strike lock has a base. The base has an opening for receiving the lock tongue. The opening is provided with at least one rotating shaft. The rotating shaft is provided with an L-shaped limiting member. The limiting member can be turned relative to the base. The limiting member can be selectively stopped on the outside of the opening, so as to confine the lock tongue in the opening, thereby achieving the purpose of locking. Alternatively, the limiting member can be selectively turned in a direction away from the opening, so that the locking tongue is disengaged from the opening to achieve the purpose of unlocking.

However, the conventional electric strike lock is controlled by a spring sleeved on the limiting member, so that the limiting member is subjected to the elastic force of the spring and has a tendency to be at the outside of the opening. A solenoid valve is provided corresponding to the limiting member. The solenoid valve has a stopper. The stopper can be selectively stopped at one side of the stopper by the solenoid valve so that the stopper cannot rotate, or it can selectively leave the stopper so that the stopper can rotate. The control is complicated in structure, and the spring is prone to elastic fatigue. Sometimes, the conventional electric strike lock may fail. On the other hand, because the limiting member of the conventional electric strike is configured to close or open the opening in a turning manner. When the external wind pressure is too large, the stopper cannot rotate smoothly toward the outside of the opening. As a result, the conventional electric strike lock cannot be unlocked smoothly. Accordingly, the inventor of the present invention has devoted himself based on his many years of practical experiences to solve these problems.

SUMMARY OF THE INVENTION

The primary object of the present invention is to provide an electric strike lock, which performs locking and unlocking operations on a door in a sliding manner and has the advantages of simple structure, high stability, and resistance to wind pressure.

In order to achieve the primary object, the present invention provides an electric strike lock, cooperating with when in use. The lock has a lock tongue. The lock tongue has a width. The electric strike lock comprises a base, two sliding members, and at least one driving unit. The base is disposed along a long-axis direction. The base has a side wall around the base. An accommodating space is defined in the side wall. The side wall has an opening section parallel to the long-axis direction. The opening section has an opening communicating with the accommodating space for accommodating the lock tongue. The base has a pair of grooves that correspond to two opposite sides of the opening and are parallel to the long-axis direction. The sliding members are slidably disposed in the respective grooves. The sliding members are configured to slide back and forth in the grooves parallel to the long-axis direction to be in a locked position or an unlocked position. When in the locked position, the sliding members slide closer to each other until a distance between the sliding members is less than the width of the lock tongue. When in the unlocked position, the sliding members gradually slide away from each other until the distance between the sliding members is greater than the width of the locking tongue. The driving unit is accommodated in the accommodating space and connected to the sliding members. The driving unit is configured to drive the sliding members to slide back and forth in the grooves for switching the locked position and the unlocked position.

The electric strike lock of the present invention can drive the sliding members to slide back and forth in the respective grooves through the driving unit, so that the sliding members are switched to be in the locked position or in the unlocked position, so as to perform locking and unlocking operations on a door in a sliding manner. Compared with the conventional electric strike lock that is controlled by turning, the electric strike lock of the present invention has the advantages of simple structure, high stability, and resistance to wind pressure.

DETAILED DESCRIPTION OF THE PREFERRED EMBODIMENTS

Embodiments of the present invention will now be described, by way of example only, with reference to the accompanying drawings.

Figure 1:
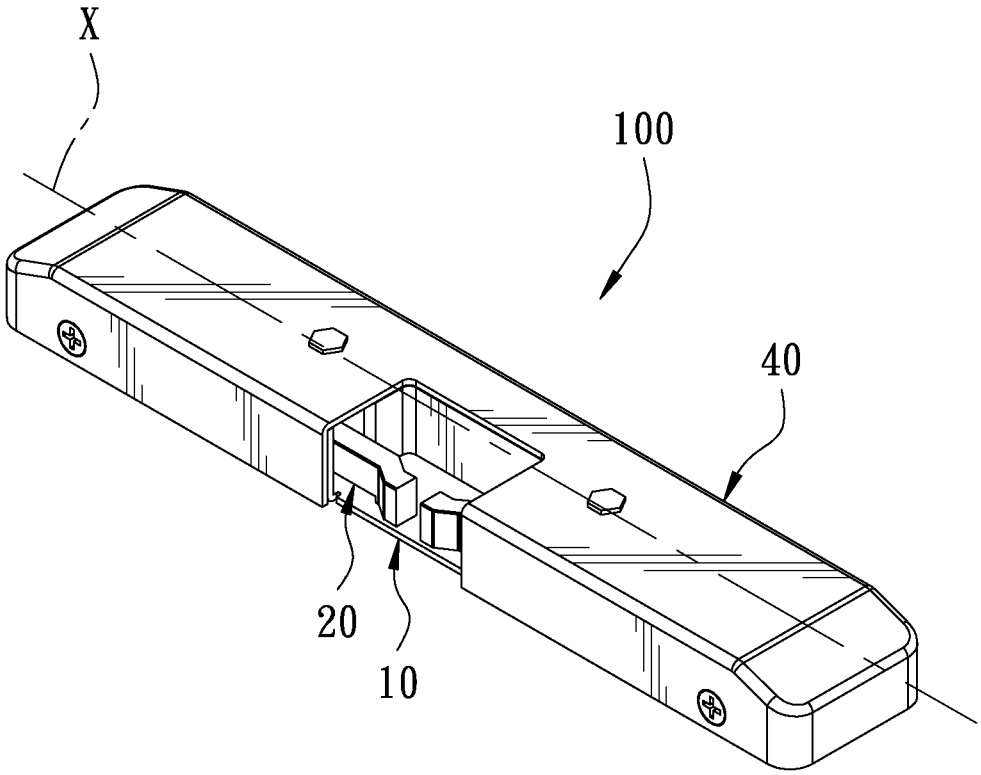
FIG. 1 is a perspective view in accordance with a preferred embodiment of the present invention.
Figure 2:
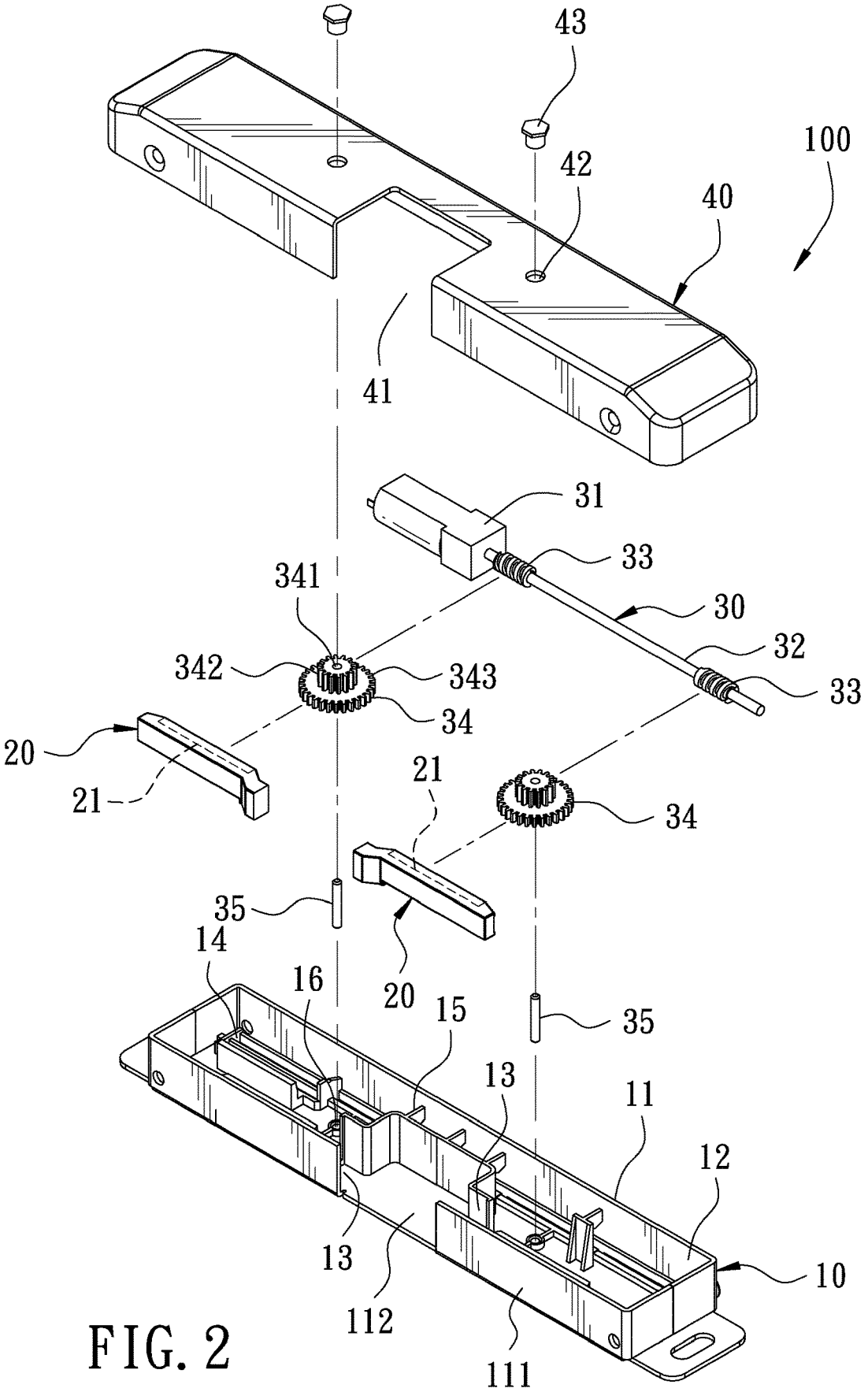
FIG. 2 is an exploded view in accordance with the preferred embodiment of the present invention.

FIG. 1 is a perspective view in accordance with a preferred embodiment of the present invention. FIG. 2 is an exploded view in accordance with the preferred embodiment of the present invention. The present invention discloses an electric strike lock 100. The electric strike lock 100 comprises a base 10, two sliding members 20, at least one driving unit 30, and a cover 40.

The base 10 is disposed along a long-axis direction X. A side wall 11 is provided around the base 10. An accommodating space 12 is defined in the side wall 11. Wherein, the side wall 11 has an opening section 111 parallel to the long-axis direction X, and the opening section 111 has an opening 112 communicating with the accommodating space 12. The base 10 has a pair of grooves 13 corresponding to two opposite sides of the opening 112 and parallel to the long-axis direction X.

The two sliding members 20 are slidably disposed in the grooves 13 and can slide back and forth in the grooves 13 parallel to the long-axis direction X, respectively. One side of each sliding member 20 has a row of teeth 21 parallel to the long-axis direction X.

The driving unit 30 is accommodated in the accommodating space 12 and is connected to the sliding members 20 so as to drive the sliding members 20 to slide back and forth in the grooves 13. Wherein, the sliding members 20 can be driven by a plurality of driving units 30 respectively, but the preferred manner is as shown in this embodiment. The driving unit 30 includes a motor 31. The motor 31 has a driving shaft 32. The driving shaft 32 is provided with two worms 33 corresponding to the teeth 21 of the sliding members 20. One of the worms 33 has a right-hand thread, and the other worm 33 has a left-hand thread. In addition, the driving unit 30 further includes two reduction gears 34. The reduction gears 34 are rotatably pivoted to the base 10 and connected between the corresponding worms 33 and the teeth 21 of the sliding member 20, respectively. Thereby, the sliding members 20 can be simultaneously driven by only one driving unit 30, so as to achieve the effects of simplifying the structure and saving power.

The cover 40 is configured to cover the base 10. The cover 40 has an enlarged opening 41 corresponding to the opening 112.

Figure 3:
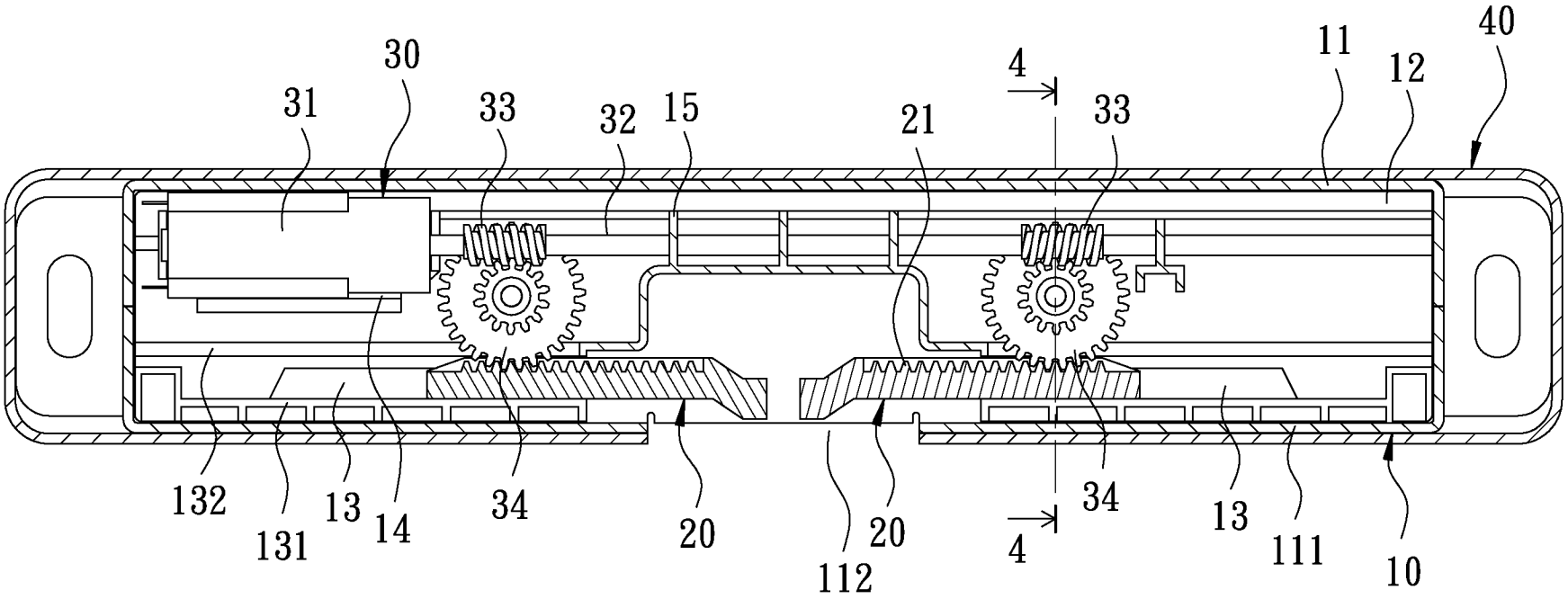
FIG. 3 is a cross-sectional view in accordance with the preferred embodiment of the present invention.

FIG. 3 is a cross-sectional view in accordance with the preferred embodiment of the present invention. Please refer to FIG. 2 and FIG. 3. The base 10 is formed with a motor groove 14 for receiving and retaining the motor 31. The base 10 is provided with a plurality of spaced retaining ribs 15 for retaining the peripheral side of the driving shaft 32 so that the driving shaft 32 can be rotated more stably. As clearly shown in the figures, the base 10 is provided with a pair of first blocking walls 131 parallel to the long-axis direction X and a pair of second blocking walls 132 parallel to the pair of first blocking walls 131 at the two opposite sides of the opening 112. The grooves 13 are surrounded by the corresponding first blocking walls 131 and the second blocking walls 132, respectively.

Figure 4:
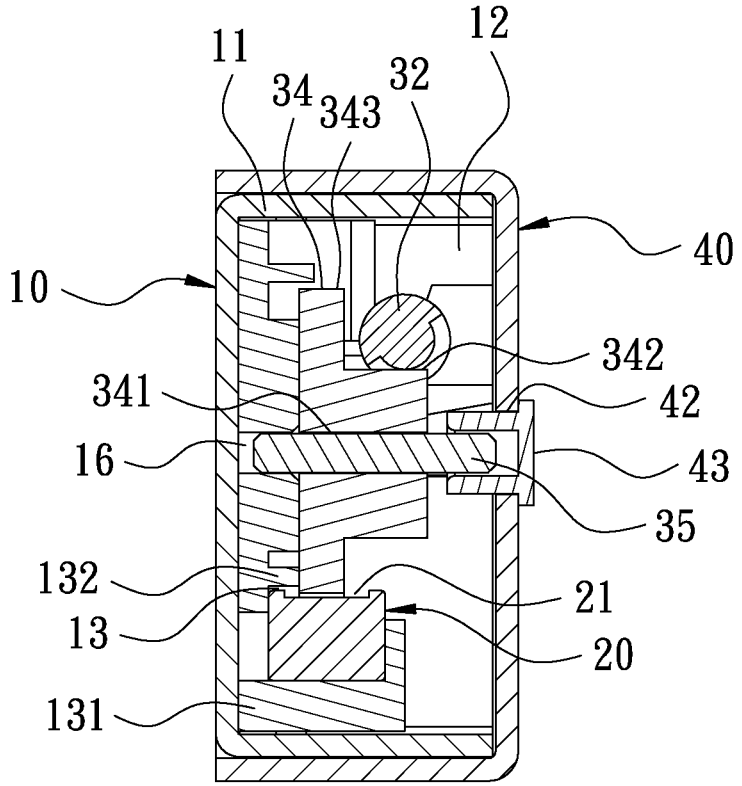
FIG. 4 is a cross-sectional view taken along line 4-4 of FIG. 3.

FIG. 4 is a cross-sectional view taken along line 4-4 of FIG. 3. Please refer to FIG. 2 and FIG. 4. The reduction gear 34 has a shaft hole 341. A rotating shaft 35 is inserted through the shaft hole 341. The base 10 is formed with a positioning hole 16 corresponding to one end of the rotating shaft 35 for receiving the end of the rotating shaft 35. The cover 40 is formed with a retaining hole 42 corresponding to the other end of the rotating shaft 35. A shaft sleeve 43 is provided in the retaining hole 42 for receiving the other end of the rotating shaft 35, so that the reduction gear 34 is rotatably pivoted on the base 10. In addition, the reduction gear 34 has a first toothed portion 342 meshed with the worm 33 and a second toothed portion 343 meshed with the teeth 21, so that the reduction gear 34 is connected between the corresponding worm 33 and the teeth 21 of the corresponding sliding member 20.

Figure 5:
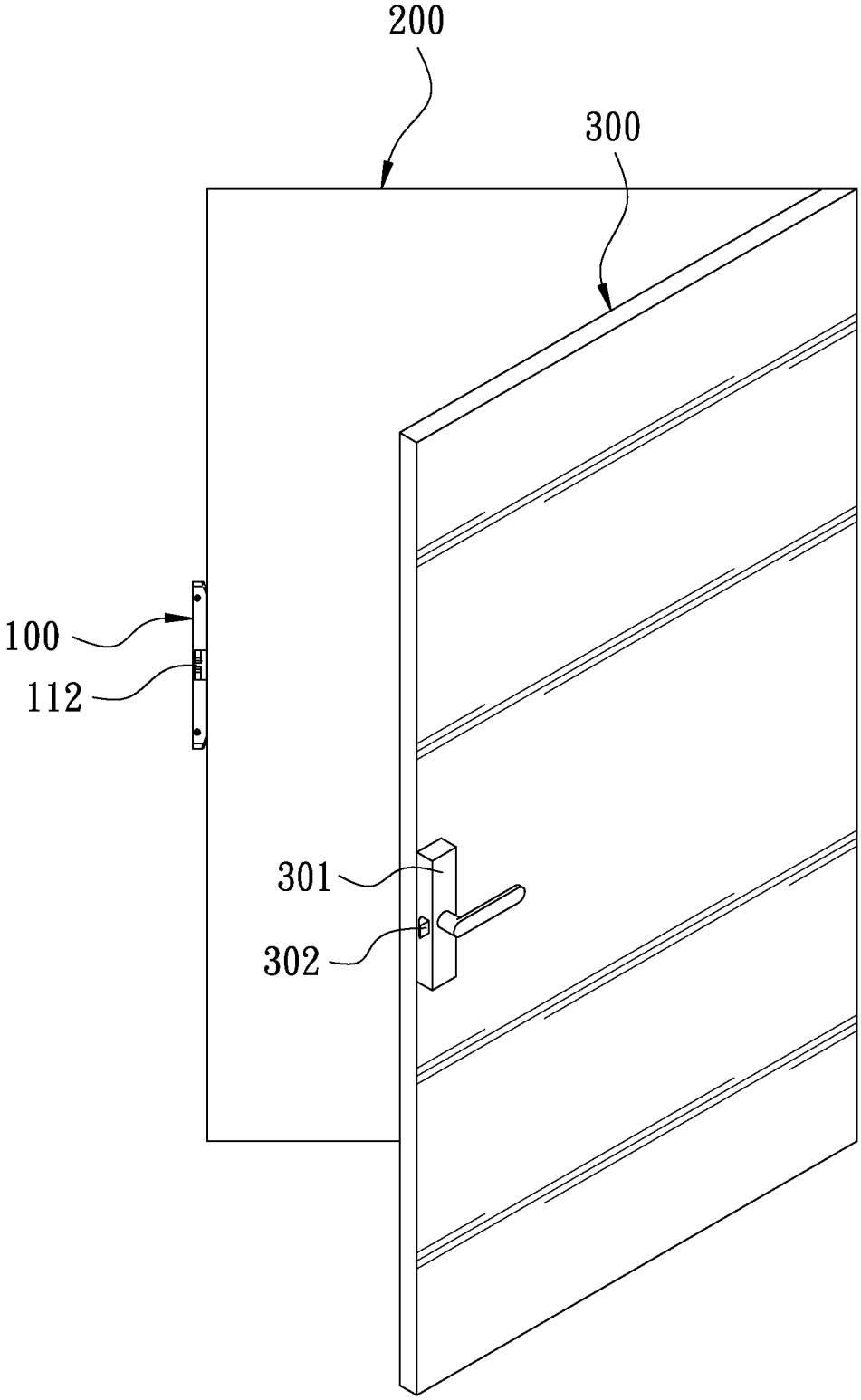
FIG. 5 is a schematic view in accordance with the preferred embodiment of the present invention when in use.

FIG. 5 is a schematic view in accordance with the preferred embodiment of the present invention when in use. The electric strike lock 100 is disposed on a door frame 200. The door frame 200 is provided with a corresponding door slab 300. The door slab 300 is provided with a lock 301. The lock 301 has a lock tongue 302. The lock tongue 302 is selectively engaged in the opening 112 of the electric strike lock 100 with the rotation of the door slab 300, or is disengaged from the opening 112 of the electric strike lock 100 with the rotation of the door slab 300 when the electric strike lock 100 is in an unlocked state.

Figure 6:
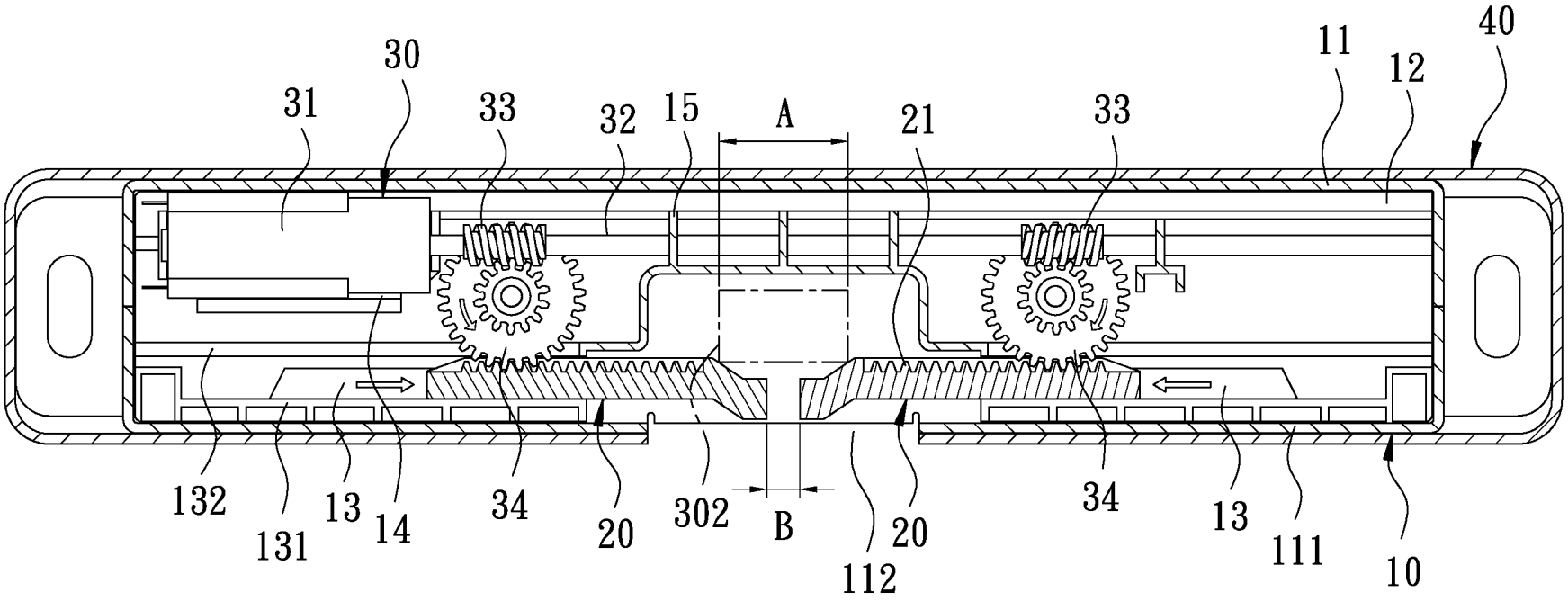
FIG. 6 is a schematic view showing the operation of the preferred embodiment of the present invention in a locked position.

FIG. 6 is a schematic view showing the operation of the preferred embodiment of the present invention in a locked position. The lock tongue 302 has a width A. When the user wants to lock the door, the motor 31 of the driving unit 30 is actuated to drive the driving shaft 32 to rotate. Because the thread directions of the worms 33 are different, the worms 33 simultaneously drive the reduction gears 34 to rotate in different directions, so that the reduction gears 34 drive the sliding members 20 to slide closer to each other until the distance B between the sliding members 20 is less than the width A of the lock tongue 302 to be in a locked position. At this time, the locking tongue 302 is confined in the opening 112, thereby achieving and the purpose of locking.

Figure 7:
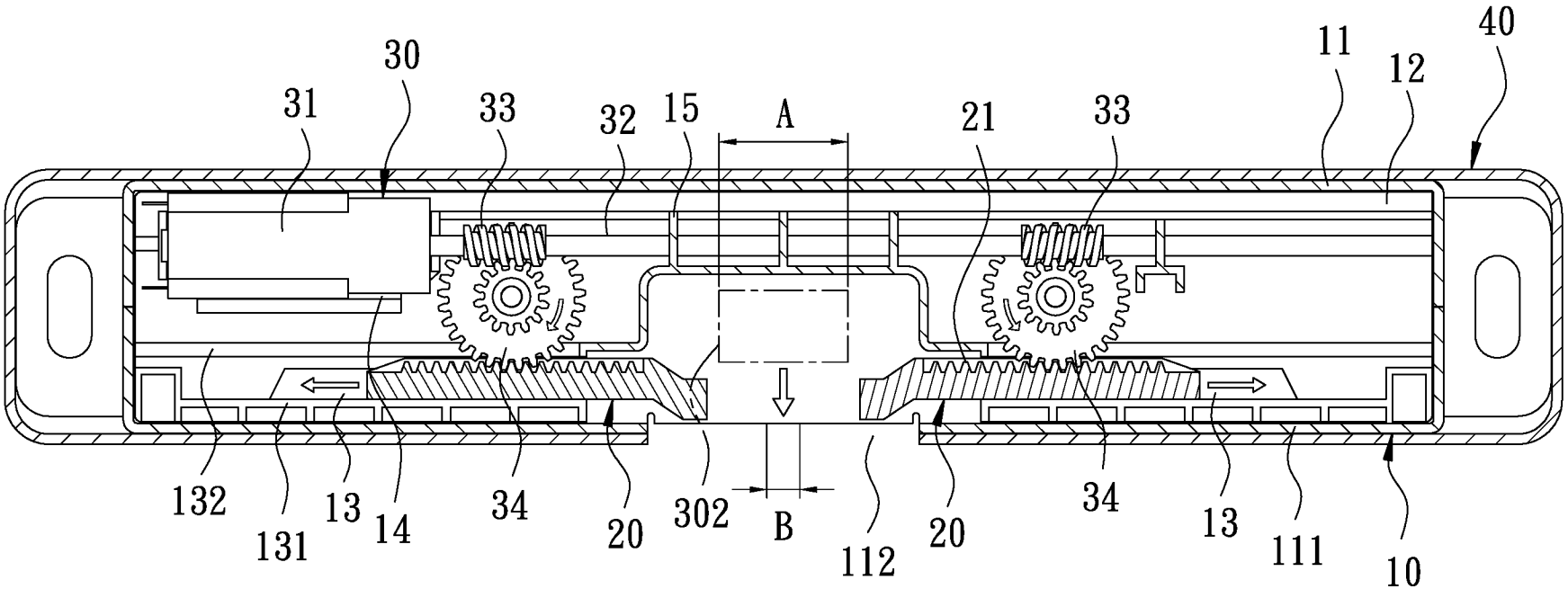
FIG. 7 is a schematic view showing the operation of the preferred embodiment of the present invention in an unlocked position.

FIG. 7 is a schematic view showing the operation of the preferred embodiment of the present invention in an unlocked position. Applying the foregoing principle, when the user wants to perform the unlocked operation, the motor 31 is switched for reverse rotation. The motor 31 drives the driving shaft 32 to rotate in the other direction, and the worms 33 simultaneously drive the reduction gears 34 to rotate in opposite directions, so as to synchronously drive the sliding members 20 to gradually slide away from each other until the distance B between the sliding members 20 is greater than the width A of the locking tongue 302 to be in an unlocked position. At this time, the locking tongue 302 can be disengaged from the opening 112, thereby achieving and the purpose of locking.

The electric strike lock 100 of the present invention can drive the sliding members 20 to slide back and forth in the grooves 13 through the driving unit 30, so that the sliding members 20 are switched to be in the locked position or in the unlocked position, so as to perform locking and unlocking operations on a door in a sliding manner. Compared with the conventional electric strike lock that is controlled by turning, the electric strike lock 100 of the present invention has a simpler structure and more stable operation. There will be no problems of elastic fatigue, nor will it be affected by wind pressure and unable to operate, thereby achieving the effect of resisting wind pressure.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electric strike lock, cooperating with a lock when in use, the lock having a lock tongue, the lock tongue having a width, the electric strike lock comprising:

a base, disposed along a long-axis direction, the base having a side wall around the base, an accommodating space being defined in the side wall, wherein the side wall has an opening section parallel to the long-axis direction, the opening section has an opening communicating with the accommodating space for accommodating the lock tongue, the base has a pair of grooves that correspond to two opposite sides of the opening and are parallel to the long-axis direction;

two sliding members, slidably disposed in the respective grooves, the sliding members being configured to slide back and forth in the grooves parallel to the long-axis direction to be in a locked position or an unlocked position; wherein when in the locked position, the sliding members slide closer to each other until a distance between the sliding members is less than the width of the lock tongue; when in the unlocked position, the sliding members gradually slide away from each other until the distance between the sliding members is greater than the width of the locking tongue; and at least one driving unit, accommodated in the accommodating space and connected to the sliding members, the driving unit being configured to drive the sliding members to slide back and forth in the grooves for switching the locked position and the unlocked position, wherein one side of each sliding member has a row of teeth parallel to the long-axis direction, the driving unit includes a motor, the motor has a driving shaft, the driving shaft is provided with two worms corresponding to the teeth of the respective sliding members, one of the worms has a right-hand thread, and the other worm has a left-hand thread.

2. The electric strike lock as claimed in claim 1, wherein the driving unit further includes two reduction gears, and the reduction gears are rotatably pivoted to the base and connected between the corresponding worms and the teeth of the sliding member, respectively.

3. The electric strike lock as claimed in claim 2, wherein the reduction gears each have a shaft hole, a rotating shaft is inserted through the shaft hole, and the base is formed with a positioning hole corresponding to one end of the rotating shaft for receiving the end of the rotating shaft so that the reduction gears are rotatably pivoted on the base.

4. The electric strike lock as claimed in claim 3, further comprising a cover, the cover being configured to cover the base, the cover being formed with a retaining hole corresponding to another end of the rotating shaft, a shaft sleeve being provided in the retaining hole for receiving the another end of the rotating shaft.

5. The electric strike lock as claimed in claim 4, wherein the cover has an enlarged opening corresponding to the opening.

6. The electric strike lock as claimed in claim 1, wherein the base is formed with a motor groove for receiving and retaining the motor, and the base is provided with a plurality of spaced retaining ribs for retaining a peripheral side of the driving shaft.

7. The electric strike lock as claimed in claim 1, wherein the base is provided with a pair of first blocking walls parallel to the long-axis direction and a pair of second blocking walls parallel to the pair of first blocking walls at the two opposite sides of the opening, and the grooves are surrounded by the corresponding first blocking walls and the second blocking walls, respectively.

* * * * *